United States Patent [19]

Roach et al.

[11] Patent Number: 4,918,907

[45] Date of Patent: Apr. 24, 1990

[54] FORMING AND FILLING FLEXIBLE PLASTIC PACKAGING

[75] Inventors: Kevin V. Roach, Carver; M. Selim Cetiner, Sudbury; Vincent E. Faherty, Brockton; Francis P. Ventura, Upton, all of Mass.

[73] Assignee: T W Kutter Inc., Avon, Mass.

[21] Appl. No.: 146,038

[22] Filed: Jan. 20, 1988

[51] Int. Cl.[5] ..... B65B 5/06

[52] U.S. Cl. ..... 53/453; 53/53; 53/246; 53/251; 53/559

[58] Field of Search ..... 53/543, 559, 560, 561, 53/236, 251, 250, 249, 246, 453, 142, 143, 53

[56] References Cited

U.S. PATENT DOCUMENTS

| | | | |
|---|---|---|---|
| 3,517,478 | 6/1970 | Winch et al. | 53/142 |
| 3,623,596 | 11/1971 | Garvey | 198/103 |
| 3,729,888 | 5/1973 | Carle | 53/251 |
| 3,874,143 | 4/1975 | Braber | 53/559 X |
| 3,942,934 | 3/1976 | Mimiyama et al. | 425/342 |
| 4,506,495 | 3/1985 | Romagnoli | 53/559 |
| 4,514,956 | 5/1985 | Varallo et al. | 53/236 X |
| 4,569,183 | 2/1986 | De Santis | 53/246 X |
| 4,655,026 | 4/1987 | Wigoda | 53/246 X |

OTHER PUBLICATIONS

Tiromed Advanced Form/Fill/Seal Technology, Meeting Today's Critical Challenges.

*Primary Examiner*—James F. Coan

*Attorney, Agent, or Firm*—Fish & Richardson

[57] ABSTRACT

Apparatus for automatically assembling and packaging articles including an assembler at which the articles are assembled and discharged one after another, a form and fill packaging line including a vacuum thermoformer where a plastic web is formed to provide receptacles for receiving the articles, a filling station where articles are placed in the formed receptacles, and a sealer where a sheet seals closed the filled receptacles, a transporting line receiving the articles from the assembler and transporting them to the filling station, the articles being presented in a group at a location spaced from the web at the filling station, and a first transfer mechanism for engaging the articles one group at a time and transferring them to a corresponding group of the receptacles at the filling station. Also disclosed are inspecting articles prior to filling receptacles so as to fill receptacles with only defect-free articles; changing spacing between finished products during transfer from a conveyor to another location; and forming the receptacles by providing a first pressure difference on opposite sides of the plastic web when heated to provide an initial contour with uniform stretching and thereafter providing a second larger pressure difference to force the heated web into the desired shape.

41 Claims, 2 Drawing Sheets

FORMING AND FILLING FLEXIBLE PLASTIC PACKAGING

BACKGROUND OF THE INVENTION

The invention relates to forming and filling flexible plastic packaging.

In form and fill packaging apparatus, a web of plastic is advanced through a vacuum thermoformer (where the plastic web is formed to provide receptacles for receiving articles), a filling station (where articles are placed in the formed receptacles), a sealer (where a second sheet is placed over the filled receptacles and sealed to portions of the web around the receptacles to provide covers), and a cutter (where the plastic web is cut at portions between receptacles into separate packages).

In such apparatus different thermoforming methods have been employed, e.g., negative forming (in which a vacuum in a female mold draws heated film into the desired shape against the female mold, with or without assistance from positive pressure on the other side of the plastic), positive male forming (in which a vacuum in a male mold and positive pressure applied on the other side of the plastic draw the heated film into the desired shape against the male mold), and male plug-assisted negative forming (in which a vacuum in a female mold and a mechanical male plug on the opposite side of film are used, with or without an optional sandwich heater).

Such apparatus has been used to form both rigid and flexible receptacles, the former in general having walls that are 8 to 50 mils in thickness (depending on the plastic and application) and maintain their shape, the latter in general having walls that are less than 8 mils in thickness and readily flex and change shape. The differences in size and properties of rigid vis-a-vis flexible walls result in differences in the responses of the plastics to heat and force and in the types of thermoforming procedures employed. Flexible film thermoforming conventionally involves simple application of vacuum to easily draw the heated plastic to the mold; there often is, however, substantial stretching of the plastic, resulting in uneven reduction in wall thickness. Rigid wall thermoforming may very well involve procedures employing assistance from positive pressure in addition to vacuum and has also involved a two-step procedure of first providing a light vacuum to provide initial contour and thereafter providing both vacuum and pressure to force the film into the shape of the mold.

SUMMARY OF THE INVENTION

In one aspect the invention features automatically supplying products assembled at an assembler to a filling station of a form and fill packaging line by using a transporting line that receives the products one-after another as assembled and presents them in groups at the filling station. A transfer mechanism then transfers the articles one group at a time to corresponding receptacles formed in a web of plastic at the filling station. In preferred embodiments the transporting line includes a gate for selectively removing articles from it and directing them to a hopper for temporary storage and a reentry mechanism for causing the articles in the hopper to reenter the transporting line. The transporting line includes a track on which the articles are maintained in a predetermined orientation as they move along the track. There is a conveyor belt at the end of the track for presenting the articles at the filling station. The conveyor belt carries the articles in two rows to the filling station, and there are two tracks for carrying the articles to the conveyor belt. The articles are syringes that have wings that are supported by spaced parallel horizontal track portions and have vertically oriented bodies between the track portions during transport.

In another aspect the invention features inspecting articles prior to transfer in groups to receptacles in order to identify defective products and selectively remove products so that only groups containing defect free products are transferred. In preferred embodiments defective articles removed from the conveyor are transferred to one bin and defect-free articles are transferred to another. The transfer mechanism waits while the conveyor incrementally moves articles to the location for transfer to the packaging line until there is a complete group of defect-free articles.

In a further aspect the invention features transferring a group of products on a conveyor to a receiving station, using separately movable product engagers to change the relative positions of the products in the groups with respect to each other (by moving the relative positions of the product engagers) prior to dropping the products off at the receiving station. In preferred embodiments the product engagers are vacuum engagement members provided on the ends of longitudinally extendable cross-arms. The ends of the cross-arms are pneumatically actuated to an extended stop position and spring-returned to a retracted position. The cross-arms are supported on a robot that is capable of movement along three orthogonal axes.

In yet a further aspect, the invention features providing more uniform plastic wall thickness in flexible receptacles formed in a plastic web in a vacuum thermoformer by initially providing a first pressure difference on opposite sides of the heated plastic web positioned in the mold to provide an initial contour with substantially uniform stretching, and thereafter applying a second, larger pressure difference to form the plastic into its desired shape. The more uniform thickness permits use of a thinner web of plastic material for a given desired wall thickness in the flexible product, and the two step procedure greatly reduces stretching and associated weakened material. In preferred embodiments, both a male mold and a female mold are used, and a light vacuum is applied in the female mold to provide the first pressure difference. Vacuum is applied in the male mold, and air pressure is applied in the female mold to provide the second pressure difference.

Other advantages and features of the invention will be apparent from the following description of a preferred embodiment thereof and from the claims.

DESCRIPTION OF THE PREFERRED EMBODIMENT

The drawings will be briefly described first.

DRAWINGS

STRUCTURE

Figure 1:
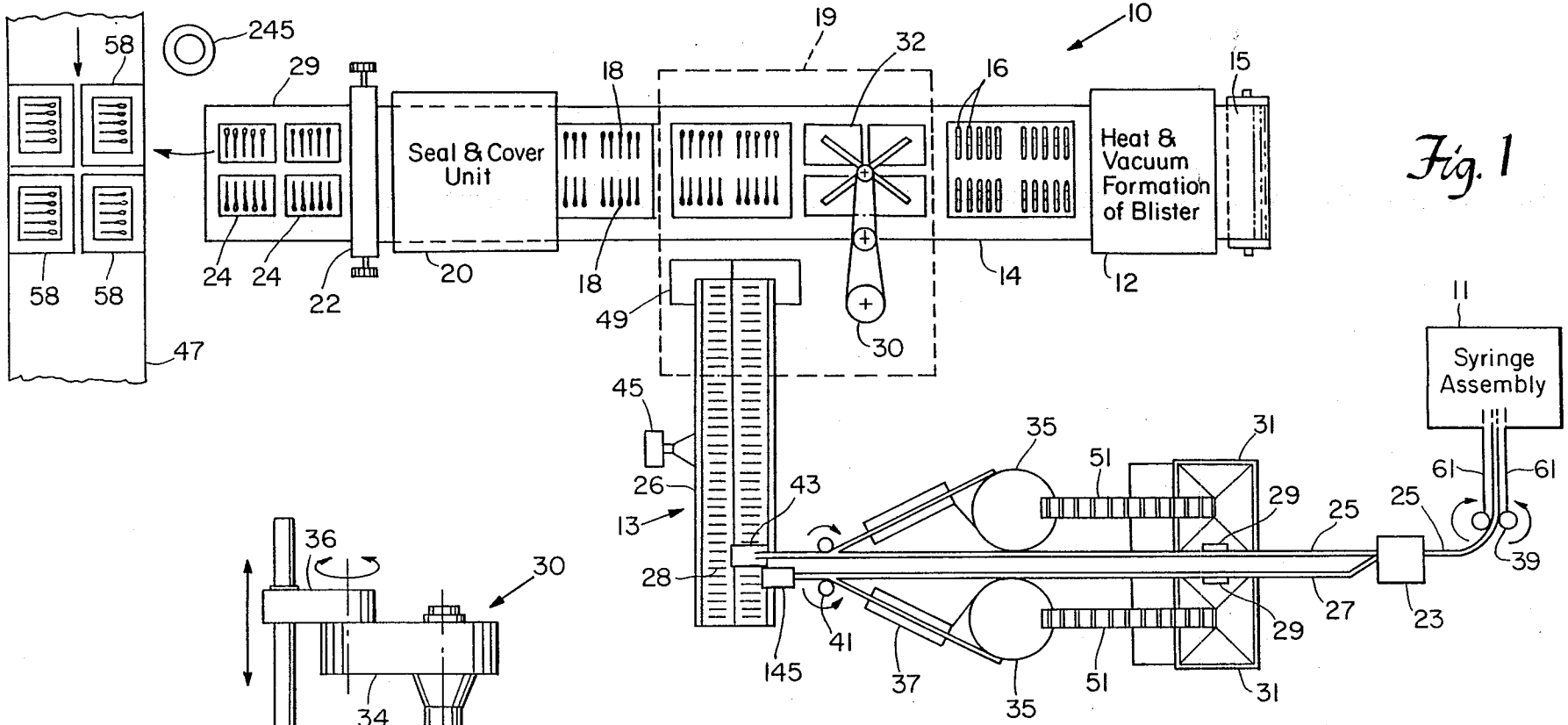
FIG. 1 is a diagrammatic plan view of form and fill packaging apparatus and associated transporting line according to, the invention.

Referring to FIG. 1, there is shown form and fill packaging apparatus 10 used in conjunction with syringe assembler 11 and transporting line 13, for transporting assembled syringes 18 for packaging at apparatus 10.

Form and fill apparatus 10 includes vacuum thermoformer 12, for forming web of plastic 14 advanced from supply roll 15 through it so as to provide formed receptacles 16 for receiving syringes 18 at downstream filling station 19. Seal and cover unit 20 is positioned to provide a cover over filled receptacles 16, and cutter 22 is positioned to cut the formed, filled, and sealed web into individual packaged products 24 containing five syringes 18 each.

Transporting line 13 includes in line tracks 25, 27 on which syringes 18 are transported with their wings extending outward over spaced horizontal portions of tracks 25, 27, the syringe bodies being vertically oriented in the space between the two portions of the tracks. Orienting rolls 61 capture syringes 18 in horizontal orientation and introduce them vertically into track 25. Diverter 23 splits the syringes coming from syringe assembler 11 on track 25 into two streams, one along the continuation of track 25 and one along track 27. Downstream of diverter 23 on tracks 25, 27 are chute gates 29 for selectively discharging syringes into hoppers 31. Each hopper 31 has an associated elevator 51, rotary disk bowl feeder 35, and orientation rolls 37 (to place syringes in vertical orientation) for returning syringes in hoppers 31 to their respective tracks 25, 27, as desired. Syringes are moved along tracks 25, 27 by upstream star wheel conveyors 39 and downstream star wheel conveyors 41. Track 25 has a one-half C end section to discharge chute 43 to reorient syringes 18 to a horizontal position and deliver syringes 18 horizontally to the left hand belt of infeed conveyor belt 26. Track 27 similarly has a one-half C end-section and associated chute 145 for delivering syringes in a horizontal manner to the right hand belt of infeed conveyor belt 26. Each belt of conveyor belt 26 has troughs 28 that are appropriately spaced for pick up by robot 30 (an Adept robot) and discharge into receptacles 16. Visual inspection monitor 45 is along belt 26. At the end of belt 26 is two compartment bin 49 having one compartment for good syringes and one for defective syringes and a mechanism (not shown) for selectively directing good and defective syringes to their respective compartments.

Robot 30 and multiple pickup member 32 of loading station 19 are positioned near the junction of infeed belt 26 and the web of formed receptacles 16, to load syringes 18 from belt 26 into receptacles 16. Conveyor 47 and robot 245 are adjacent to the end of belt 29, carrying packaged products 24 from cutter 22.

Figure 2:
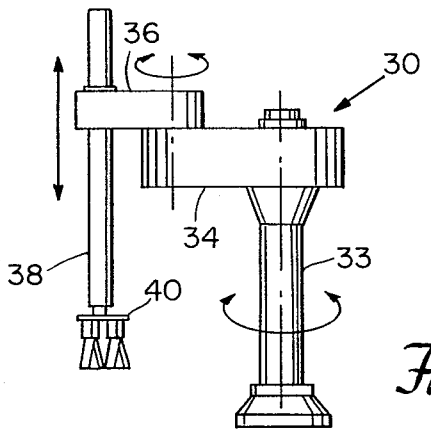
FIG. 2 is a diagrammatic elevation of a robot used in the FIG. 1 apparatus to transfer syringes from a supply belt to formed receptacles.
Figure 5:
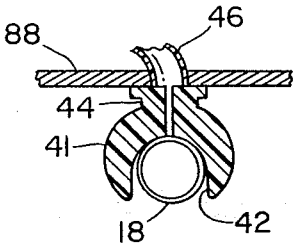
FIG. 5 is a diagrammatic vertical sectional view of an engagement foot of the FIG. 3 mechanism shown engaging a syringe.
Figure 3:
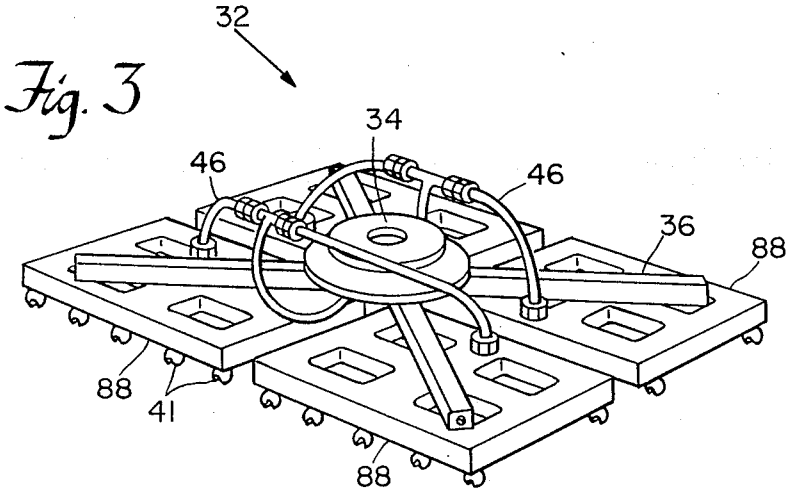
FIG. 3 is a diagrammatic perspective view of an article pickup mechanism of the FIG. 1 apparatus.
Figure 4:
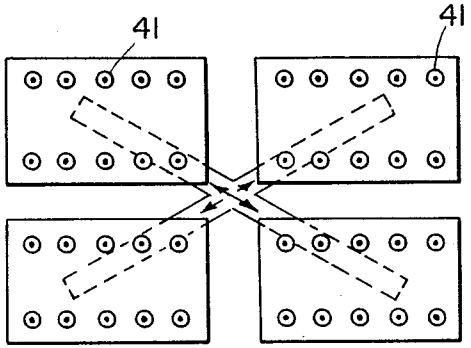
FIG. 4 is a diagrammatic bottom plan view of the FIG. 3 pickup mechanism.

Referring to FIG. 2, robot 30 includes rotatable main shaft 33, primary arm 34 connected to it, secondary arm 36 rotatably connected to arm 34, and shaft 38. Shaft 38 is mounted for vertical movement on arm 36 and carries, on its lower end, bracket 40, for mounting to pickup member 32. Referring to FIGS. 2, 3 and 4, pickup member 32 includes flange 34, for attaching to bracket 40, and cross arms 36 secured at respective ends to four pads 88, each of which has ten rubber feet 41 in position to engage syringes 18. Referring to FIG. 5, each foot 41 has a U-shaped recess 42 and vacuum passage 44, leading to recess 42 and connected to vacuum tubes 46. Robot 245 carries a multiple pickup member and rotatable arms (not shown) that is similar to member 32, except that its feet are shaped like suction cups, and its cross arms are longitudinally extendable.

Figure 6:
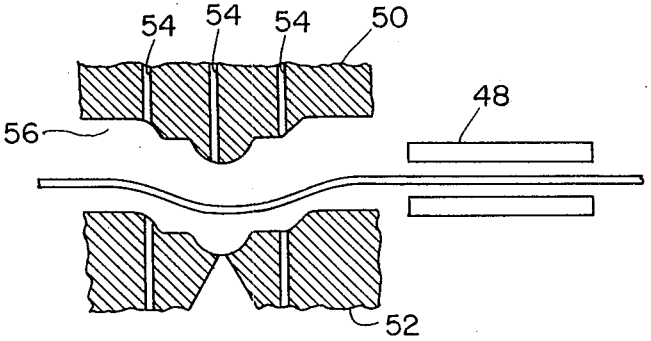
FIG. 6 is a diagrammatic vertical sectional view of a heater and portions of multiple-receptacle molds of a thermoformer of the FIG. 1 apparatus in position during an initial step of a forming operation.
Figure 7:
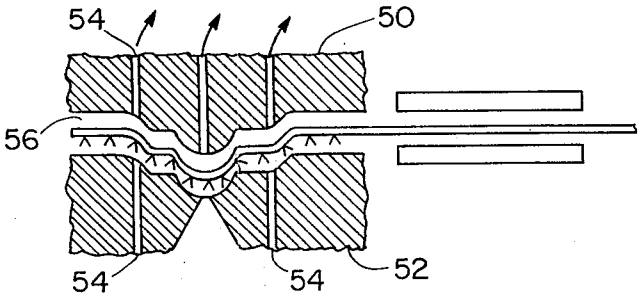
FIG. 7 is a diagrammatic vertical sectional view of a heater and portions of multiple receptacle molds of the FIG. 1 apparatus in a later step of the forming operation.

Referring to FIGS. 6 and 7, sandwich heater 48 and portions of water-cooled male mold 50 and female mold 52 used to form a receptacle 16 in vacuum thermoformer 12 are shown. Molds 50, 52 include passages 54 for selectively providing vacuum or positive pressure to region 56 between them.

OPERATION

In forming receptacles 16 in web 14, web 14 is advanced from roll 15, heated at heater 48 (FIGS. 6 and to, e.g., about 80° C. to 90° C., and thereafter advanced to position between male and female molds 50, 52. Heated web 14 is subjected to a light vacuum applied at female mold 52, causing a difference in pressure on opposite sides of web 14 that urges web 14 to begin assuming the shape of female mold 52 with uniform stretching (FIG. 6). Thereafter vacuum is applied at male mold 50 and positive pressure is applied at female mold 52 (FIG. 7), causing a larger difference in pressure (and in the opposite direction) and web 14 to move into contact with water-cooled (e.g., about 65° F.) male mold 50 continuously along its surface. When the plastic contacts the cooled mold, it quickly cools in the desired shape. High quality mold contact is provided by the combined vacuum and air pressure. The two-step procedure has about a 3–5 second cycle, with about ¼ to ½ second in the first step, depending on the plastic and thickness. The two-step procedure greatly reduces stretching and the resulting weakened material and provides more uniform wall thickness in the resulting formed receptacle. Thinner, less expensive stock can thus be used while maintaining desired, minimum thicknesses. E.g., use of 4.5 mil K resin (butadiene-styrene polymer) plastic web results in a minimum wall thickness of 1.5 mils in receptacles 16, which is significantly better than the 0.75 mil minimum thickness resulting from 6.5 mil thick starting material when using a prior process.

After a group of receptacles 14 has been formed, web 14 is advanced to move a fresh portion of the web into thermoformer 12 and to move twenty formed receptacles 16 into position at filling station 19 for simultaneous filling with a group of twenty syringes 18.

Syringes 18 are assembled at syringe assembler 11 and discharged to orienting rolls 61 one-at-a-time in horizontal orientation as they are assembled. Syringes 18 are vertically oriented at rolls 61 and received on track 25, where the syringes maintain the vertical orientation with the wings extending over spaced horizontal members of track 25. Star wheel mechanism 39 pushes syringes between its two wheels along track 25. At diverter 23 some of the syringes are diverted to track 27. The syringes continue along tracks 25, 27 and are delivered at chutes 43, 145 in horizontal orientation to the left- and right-hand rows of troughs 28, receiving an additional push at star wheels 41, 43.

In the event that syringe assembler 11 works faster than form and fill apparatus 10 or there is a problem requiring temporary shutdown of line 10, syringes 18 can be discharged and temporarily stored into hopper 31 and later incorporated back into the feed to infeed belt 26 at a time when form and fill line 10 is operating faster than assembler 11 or at a time when assembler 11 is not operating. The discharge of syringes into hopper 31 is controlled by chute gates 29. When the syringes reenter tracks 25, 27, they are raised by elevator 30 to rotary disk bowl feeder 35, which feeds the syringes 18 to orienting rolls 37 at which the syringes are placed in their vertical orientation with the wings on opposite sides of an opening between horizontal track members. Hoppers 31 can also be manually loaded with previously assembled syringes in the event of failure of syringe assembler 11.

Syringes delivered to troughs 28 of infeed belt 26 are advanced toward form and fill line apparatus 10 and are scanned by inspection station 45 to determine if there are any defective syringes (for example, whether the spacing between the wings and the plunger is within specifications, and whether all parts are present). The left- and right-hand belts of conveyor belt 26 operate synchronously when defective parts are not detected. Twenty syringes 18 are transferred at a time by robot 30 in four groups of five. If inspection station 45 identifies a faulty syringe, it is dropped into bin 47 along with any other syringes that would prevent transfer of a group of twenty defect free syringes; for example, if the defective syringe was the fourth one from the front on the right-hand side of a group of twenty to be transferred, then the right-hand belt advances four increments, discharging the defective fourth syringe and the three syringes before it on the right-hand belt into the bin. The gate in bin 47 directs the first three defect free syringes to one compartment and the defective fourth syringe to another.

In making the transfer of syringes 18 from belt 26 to receptacles 16, pickup member 32 is lowered into position over infeed belt 26 by vertical movement of shaft 38, and a vacuum applied to feet 41 causes engagement of syringes 18, two feet 41 engaging each syringe 18. Pickup member 32 is then raised by movement of shaft 38 and moved into the position shown in FIG. 1 by relative rotation of arms 34, 36 and rotation of primary shaft 33. Pickup member 32 is then lowered, and the vacuums are disengaged, permitting syringes 18 to fall into their respective receptacles 16. In travel of syringes 18 from assembler 11 to receptacles 16, syringes 18 maintain predetermined orientations during travel and are captured at all times.

As web 14 advances, the filled receptacles 16 are moved to seal and cover unit 20, where a cover sheet is sealed to the portions of web 14 between and around the receptacles. As web 14 advances further, the loaded, covered, and sealed receptacles are then vertically and horizontally cut at cutter 22 to provide individual packaged products 24 of five syringes each. Robot 245 (similar to robot 30) transfers sealed packaged products 24, four at a time, to four boxes 58 on conveyor 47, alternating the orientation of each layer, and extending arms 36 before releasing packaged products 24 in boxes 58 to provide spacing for boxes 58. After a set of boxes 58 has been loaded, conveyor 47 moves a new set of four boxes 58 into position. Packaged products 24 can be sterilized by electron beam, ethylene oxide, or radiation sterilization and reliably maintain their integrity and sterilization, owing to the wall thickness.

OTHER EMBODIMENTS

Other embodiments of the invention are within the scope of the following claims.

What is claimed is:

1. Apparatus for automatically assembling and packaging articles comprising an assembler at which said articles are assembled and discharged one after another, a form and fill packaging line including a vacuum thermoformer where a plastic web is formed to provide receptacles for receiving said articles, a filling station where articles are placed in the formed receptacles, and a sealer where a sheet seals closed the filled receptacles, a transporting line receiving said articles from said assembler and transporting them to said filling station, said articles being presented in a group at a location spaced from said web at said filling station, and a first transfer mechanism for engaging said articles one group at a time and transferring them to a corresponding group of said receptacles at said filling station.

2. The apparatus of claim 1 further comprising a means for selectively removing articles from said transporting line, a hopper for receiving said articles when removed, and a reentry mechanism for causing the articles in the hopper to reenter the transporting line.

3. The apparatus of claim 1 wherein said transporting line comprises a first track on which said articles are maintained in predetermined orientation as they move along said track.

4. The apparatus of claim 3 further comprising a conveyor belt at the end of said track for presenting said articles at said filling station.

5. The apparatus of claim 4 further comprising a diverter for selectively diverting some of said articles in said first track, a second track for receiving said articles diverted from said first track, and a loader for loading the articles on said first and second tracks into two rows on said conveyor belt.

6. The apparatus of claim 5 wherein said first transfer mechanism includes means for engaging a group of articles including articles in said two rows.

7. The apparatus of claim 4 further comprising pushing means to convey said articles along said track.

8. The apparatus of claim 3 wherein said articles are syringes, each having wings extending from a body, and said track includes parallel horizontal portions, said portions being spaced from each other so as to permit passage of the bodies of said syringes therebetween and to support the wings of said syringes.

9. The apparatus of claim 1 further comprising article inspection means for identifying defective articles prior to transfer, and article removal means for selectively removing inspected articles so that only groups containing defect free articles are transferred by said transfer mechanism.

10. The apparatus of claim 1 further comprising a second transfer mechanism for removing groups of packaged articles from said packaging line and placing them in boxes.

11. The apparatus of claim 10 wherein said second transfer mechanism includes means for engaging a plurality of groups of packaged articles at a time, adjusting the relative positioning of each group with respect to the others during transfer from said packaging line to said boxes, and depositing said groups in separate boxes.

12. Apparatus for automatically packaging articles comprising groups of receptacles for receiving said articles, a filling station where articles are placed in said receptacles a packaging line, means for automatically moving said receptacles along said packaging line past said filling station, a conveyor presenting said articles to said filling station, said articles being presented in groups at a location spaced from said group of receptacles at said filling station, a transfer mechanism for engaging said articles one group at a time and transferring them to a corresponding group of receptacles at said filling station, article inspection means for identifying defective articles on said conveyor, and article removal means for selectively removing articles so that only groups containing defect-free articles are transferred by said transfer mechanism.

13. The apparatus of claim 12 wherein said article removal means comprises means for transferring defective removed articles to one bin and defect free removed products to another bin.

14. The apparatus of claim 12 wherein said conveyor comprises a conveyor belt and means for presenting said articles at said filling station on said conveyor belt in two rows, and said transfer mechanism includes means for engaging a group including articles in said two rows.

15. The apparatus of claim 14 wherein there are a plurality of articles in each row in a said group, each row is provided on a separately movable belt, and said transfer mechanism includes means for delaying transfer while said conveyor belt incrementally moves said articles to said location until there is a complete group of defect-free articles for transfer by said transfer mechanism.

16. The apparatus of claim 12 wherein said articles are syringes each having a plunger and wings.

17. The apparatus of claim 16 wherein said inspection means includes means for determining the distance from said plunger to said wings.

18. The apparatus of claim 16 wherein said inspection machine includes means for verifying that all parts of said syringes are present.

19. The apparatus of claim 12 wherein said packaging line comprises a vacuum thermoformer for forming a plastic web to provide said receptacles and a sealer for sealing closed with a sheet receptacles filled at said filling station.

20. Apparatus for simultaneously transferring a group of products from one location to another comprising a conveyor presenting said products in a group having first predetermined positions characterized by a first spacing with respect to each other at a first predetermined location, a product receiving station at a second predetermined location spaced from said first location, said product receiving station having second predetermined product positions characterized by a second spacing with respect to each other different from said first spacing, and a transfer mechanism that is movable between said first and second predetermined locations and includes a plurality of product engagers for engaging respective products in a said group, said product engagers being movable with respect to each other so as to engage said products at said first predetermined positions at said first location and to disengage said products at said second predetermined positions at said product receiving station.

21. The apparatus of claim 20 wherein said product engagers comprise vacuum engagement members.

22. The apparatus of claim 21 and further comprising a plurality of longitudinally extendable arms, at least some of said vacuum engagement members being mounted on respective ones of said longitudinally extendable arms in order to change the positions of the members.

23. The apparatus of claim 20 wherein each said product comprises a package including a plurality of articles.

24. The apparatus of claim 22 wherein there are four said vacuum engagement members and said longitudinally extendable members form a pair of cross arms, each vacuum engagement member being mounted at one end of said pair of cross-arms, each said end being longitudinally extendable.

25. The apparatus of claim 24 and further comprising means for pneumatically extending said ends.

26. The apparatus of claim 25 and further comprising means for pneumatically extending said ends to a stop position and spring returning said ends to a return position.

27. The apparatus of claim 24 and further comprising a robot that is capable of movement along three orthogonal axes and supports said cross-arms.

28. The apparatus of claim 20 wherein said conveyor comprises a conveyor belt, and further comprising separate boxes at said second predetermined positions.

29. The apparatus of claim 28 wherein said products are packages including a plurality of articles, and further comprising a vacuum thermoformer where a plastic web is formed to provide receptacles for said articles, a filling station where articles are placed in the formed receptacles, and a sealer where a sheet seals closed the filled receptacles to provide said packages.

30. In forming and filling flexible plastic packages comprising forming a web of plastic pulled through and processed in a thermoformer to provide formed receptacles, placing articles in said formed receptacles to provide filled receptacles, providing a cover over said filled receptacles, sealing said cover to said web around said receptacles, and cutting said web between said filled receptacles to provide separate packages, the improvement wherein said forming comprises, advancing a thin flexible web of plastic through said thermoformer, providing a first pressure difference on opposite sides of said plastic web when heated and positioned in a mold of said thermoformer to provide an initial contour with substantially uniform stretching of said heated, plastic web, and thereafter providing a second pressure difference which is larger than said first pressure difference and is sufficiently large to force the heated plastic web into the desired shape of a mold of said thermoformer to provide formed receptacles with a wall thickness at least equal to a predetermined minimum thickness sufficient to maintain integrity of said packages.

31. The method of claim 30 wherein said thermoformer includes a female mold and a facing male mold, and said first pressure difference is provided by a light vacuum at the female mold.

32. The method of claim 31 wherein said second pressure difference is provided by positive pressure at the female mold and vacuum at the male mold.

33. The method of claim 32 wherein said placing comprises simultaneously transferring a group of articles from an infeed belt to said receptacles.

34. The method of claim 33 wherein said transferring comprises engaging said articles at said infeed belt with vacuum engagement feet and disengaging said articles from said vacuum engagement feet at said formed receptacles.

35. The method of claim 34 wherein said articles are syringes with barrels.

36. The method of claim 35 wherein said vacuum engagement feet have U-shaped recesses for engaging the barrels of said syringes.

37. The method of claim 32 and further comprising transferring said separate packages to boxes.

38. The method of claim 37 wherein said transferring said separate packages comprises simultaneously transferring multiple packages to multiple boxes.

39. The method of thermoforming flexible plastic web in a thermoformer comprising advancing a thin flexible web of plastic through said thermoformer, providing a first pressure difference on opposite sides of said plastic web when heated and positioned in a mold of said thermoformer to provide an initial contour with substantially uniform stretching of said heated, plastic web and thereafter providing a second pressure difference which is larger than said first pressure difference and is sufficiently large to force the heated web into the desired shape of a mold of said thermoformer to provide a wall thickness at least equal to a predetermined minimum thickness sufficient to maintain integrity.

40. The method of claim 39 wherein said thermoformer includes a female mold and a facing male mold, and said first pressure difference is provided by a light vacuum at the female mold.

41. The method of claim 40 wherein said second pressure difference is provided by positive pressure at the female mold and vacuum at the male mold.

* * * * *